US009062648B2

(12) United States Patent
Bohne et al.

(10) Patent No.: US 9,062,648 B2
(45) Date of Patent: Jun. 23, 2015

(54) METHOD FOR OPERATING A HF IGNITION SYSTEM

(75) Inventors: Steffen Bohne, Freiberg (DE); Martin Trump, Stuttgart (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 333 days.

(21) Appl. No.: 13/585,304

(22) Filed: Aug. 14, 2012

(65) Prior Publication Data

US 2013/0049601 A1 Feb. 28, 2013

(30) Foreign Application Priority Data

Aug. 24, 2011 (DE) ..... 10 2011 052 949
Aug. 31, 2011 (DE) ..... 10 2011 053 169

(51) Int. Cl.

| | |
|---|---|
| ***F02P 15/10*** | (2006.01) |
| ***F02P 17/12*** | (2006.01) |
| ***F02P 9/00*** | (2006.01) |
| ***F02P 11/06*** | (2006.01) |
| ***F02P 23/04*** | (2006.01) |
| *F02D 41/20* | (2006.01) |
| *F02D 41/28* | (2006.01) |

(52) U.S. Cl.

CPC ..... *F02P 17/12* (2013.01); *F02P 9/007* (2013.01); *F02P 15/10* (2013.01); *F02D 2041/2086* (2013.01); *F02D 2041/2051* (2013.01); *F02P 11/06* (2013.01); *F02P 23/04* (2013.01); *F02D 2041/288* (2013.01); *F02P 2017/121* (2013.01)

(58) Field of Classification Search

USPC ..... 123/143 B, 606, 607, 623, 645; 73/114.01–114.11, 114.67

See application file for complete search history.

(56) References Cited

U.S. PATENT DOCUMENTS

| | | | | |
|---|---|---|---|---|
| 5,777,216 | A * | 7/1998 | Van Duyne et al. | 73/114.67 |
| 8,746,218 | B2 * | 6/2014 | Freen | 123/623 |
| 2010/0282198 | A1 * | 11/2010 | Hampton et al. | 123/143 B |
| 2011/0114071 | A1 | 5/2011 | Freen | |
| 2011/0197865 | A1 * | 8/2011 | Hampton | 123/623 |
| 2011/0305998 | A1 | 12/2011 | Toedter et al. | |
| 2013/0319384 | A1 * | 12/2013 | Trump et al. | 123/623 |

FOREIGN PATENT DOCUMENTS

| | | | |
|---|---|---|---|
| DE | 10 2008 061 788 | A1 | 6/2010 |
| DE | 10 2010 062 304 | A1 | 6/2012 |
| EP | 1 515 594 | A2 | 3/2005 |
| WO | WO 98/11388 | A1 | 3/1998 |

* cited by examiner

*Primary Examiner* — Erick Solis

(74) *Attorney, Agent, or Firm* — Hackler Daghighian & Martino

(57) ABSTRACT

The invention relates to a method for operating a HF ignition system, wherein electrical energy for generating a corona discharge is fed with a voltage pulse into the HF ignition system and a series of measured values of an electrical variable is measured during the voltage pulse, and the measured values are evaluated in order to detect malfunctions. It is provided according to the invention that the measured values are evaluated by determining a characteristic variable for the fluctuation range of the same and comparing the determined characteristic variable with a threshold, or in that by means of a transformation of said series, the frequency spectrum of said series is calculated, and it is checked for at least one frequency range if a threshold is exceeded.

10 Claims, 1 Drawing Sheet

METHOD FOR OPERATING A HF IGNITION SYSTEM

The invention is based on an ignition system for igniting fuel in a vehicle engine by means of a corona discharge. Such ignition systems are usually called corona or HF ignition systems. The invention relates to a method for operating a HF ignition system for igniting fuel in a vehicle engine by means of a corona discharge. A method with the features specified in the preamble of claim 1 is known from DE 10 2008 061 788 A1. An HF ignition system and a method for operating the same is also known from EP 1 515 594 A2.

HF ignition systems use a voltage converter, e.g., a transformer, to generate high voltage from an on-board voltage, which high voltage is used for HF excitation of an electrical resonant circuit to which the ignition electrode is connected. Thus, HF ignition systems have a voltage converter which has an input side for connecting to the on-board power net of a vehicle and an output side which is connected to an electrical resonant circuit for HF excitation of an ignition electrode. The resonance frequency of the resonant circuit normally ranges between 30 kHz and 10 MHz. The alternating voltage typically reaches values at the ignition electrode between 30 kV and 500 kV.

Igniting fuel by means of corona discharges is an alternative to conventional spark plugs which effect the ignition by means of an arc discharge and are subject to significant wear due to electrode burn-off. Corona ignitions have the potential of significant cost savings and improvement of fuel combustion. However, apart from the desired corona discharge, it is also possible that within the context of malfunctions, arc-, spark- or sliding-discharges occur.

SUMMARY OF THE INVENTION

It is an object of the invention to show a way on how such malfunctions can be detected.

This object is achieved by a method for operating an HF ignition system while the engine is running comprising the features specified in the claim 1 and by a method for operating an HF ignition system according to claim 6 while an engine, in which fuel is ignited by a corona discharge produced by the HF ignition system, is running. Advantageous refinements of the invention are subject matter of the sub-claims.

In the method according to the invention, electrical energy is fed with a voltage pulse into the HF ignition system in order to generate a corona discharge. During the duration of this voltage pulse, a series of measurements of an electrical variable, for example, the secondary voltage generated by a voltage converter from the voltage pulse, is measured. The measured values are evaluated in order to detect malfunctions. If a malfunction is detected, an error signal is generated which preferably reduces the energy fed with a subsequent voltage pulse into the HF ignition system for igniting a further corona discharge. For example, the duration and/or the voltage of the voltage pulse may be reduced. However, the error signal can also be reported as a warning or error signal to the engine control unit and/or can be stored in a storage which can be read out, for example, for maintenance work.

Malfunctions of HF ignition systems are based to a large extent on the fact that instead of a corona discharge, a spark discharge or sliding discharge occurs, or that during a corona discharge, a spark or sliding discharge forms. These discharges can occur at the ignition electrode as external discharges instead of a corona discharge, but also internally in the case of defects inside the HF ignition system. Such malfunctions can be detected based on a characteristic curve of an electrical variable which is measured during a discharge or during the voltage pulse fed into the HF ignition system in order to generate a corona discharge. For detecting malfunctions, in particular the strength of the electrical current and/or the voltage can be measured. However, as an alternative, other electrical variables, for example the impedance frequency or the resonance frequency of an electrical resonant circuit included in the HF ignition system, can be measured.

Within the context of the invention it was found that as a pre-stage of serious malfunctions, in particular internal spark and sliding discharges, periodic fluctuations of the secondary voltage, i.e., the high voltage generated by the ignition system or other electrical variables, frequently occur. According to the invention, the occurrence of these fluctuations is recorded in order to be able to detect malfunctions already at an early stage.

One aspect of the present invention relates to a method in which a characteristic variable for the fluctuation range of the measured values is determined, and the characteristic variable is compared to a predetermined threshold. If the characteristic variable of the fluctuation range exceeds the threshold, a malfunction is assumed and an error signal is generated. As a characteristic variable for the fluctuation range of the measured values the standard deviation thereof may be used.

A second aspect of the invention relates to another possibility to detect periodic fluctuations of electrical measurands and thus to detect emerging malfunctions. According to the invention, the measured values are evaluated by calculating a frequency spectrum of the series of measured values, for example through a time-frequency transformation, e.g. a Fourier transformation or wavelet transformation, and by subsequently checking, for at least one frequency range, if a threshold is exceeded. If this is the case, an error signal is generated.

Periodic fluctuations of the electric measurands occur in most cases with characteristic frequencies. In order to detect a malfunction, it is therefore normally sufficient to check a single or few frequency ranges in which the frequencies lie, which are characteristic for malfunctions. It is possible here to use different thresholds for different frequency ranges. However, it is preferred to use a uniform threshold for all frequency ranges to be evaluated.

Particularly informative for the presence of potential malfunctions of an HF ignition system are measured values which are measured during a middle portion of the voltage pulse which, for generating a corona discharge, is fed into the HF ignition system.

During a start and an end portion of the voltage pulse, the characteristic electrical variables change considerably. Even during a faultless operation of an HF ignition system, a corona discharge occurs during the start portion of the voltage pulse, and the corona discharge extinguishes during an end portion of the voltage pulse. Current, voltage and other electrical variables change significantly when the corona discharge ignites and extinguishes. In contrast, in a properly functioning HF ignition system, a middle voltage pulse portion is largely characterized by constant conditions. Therefore, the middle portion of the voltage pulse is suited in a particularly advantageous manner for detecting potential malfunctions.

Before the middle portion lies a start portion which is characterized by the increase of the voltage and transient responses. After the transient response of the secondary voltage, which is generated by feeding the voltage pulse, largely constant conditions occur during a faultless operation.

Preferably, the electrical variable is measured on the high voltage side of the HF ignition system. HF ignition systems have an on-board power net side and a high voltage side, wherein between the on-board power net side and the high voltage side, a voltage converter is arranged which, from an on-board voltage generates a high voltage as a secondary voltage, preferably a voltage of at least 15 kV, particularly preferred at least 30 kV, in particular at least 50 kV. Sliding discharges or spark discharges can, in principle, also be detected by measurements on the on-board power net side; however, they appear more clearly in electrical variables which are measured on the high voltage side. The high voltage side can comprise an intermediate circuit in which the electrical variables can be measured in an advantageous manner.

Malfunctions of a HF ignition system, such as spark discharges or sliding discharges, can be based on the fact that for generating a corona discharge, too much energy has been fed. The malfunction can be eliminated in many cases if upon detection of a malfunction, the energy fed into the HF ignition system with a following voltage pulse is reduced. However, it can also happen that a malfunction, for example a sliding discharge, is based on a defect of the HF ignition system. It is therefore preferred in a method according to the invention to predetermine a lower threshold for the energy fed with a voltage pulse into the HF ignition system and to generate an error signal if at that lower threshold a malfunction of the HF ignition system is detected. The error signal can be, for example, a message to an engine control unit (ECU) or to an OBD error memory. If a spark discharge or a sliding discharge occurs even during a voltage pulse with such low energy, it can usually be assumed that the HF ignition system is defective and should be replaced or repaired as soon as possible. The lower threshold is preferably specified such that the corresponding energy is sufficient for generating a corona discharge and thus sufficient for at least a limited function of the HF ignition system.

Since to frequency superpositions, for example of the resonance frequency, may cause incorrect evaluations, filtering can be carried out prior to the actual evaluation. Filtering the curve of the measured electrical variable through a frequency range, for example around the resonance frequency, enables to analyze extreme values or upper waves, which are characteristic for the evaluation, in detail and separately.

It is possible to specify predetermined time periods for the start portion of the voltage pulse and the end portion of the voltage pulse, for example by measuring the electrical measured values in constant time intervals, and by excluding a specified number of measured values at the beginning and the end of the series. Preferably, in addition to the middle portion of the voltage pulse, values during a start portion or an end portion of the voltage pulse are also considered for the evaluation. For example, it is possible to specify for the start portion and/or the end portion in each case a different target range for the time derivation of the electrical variable.

BRIEF DESCRIPTION OF THE DRAWINGS

Further details and advantages of the invention are explained below with reference to the attached figures.

DETAILED DESCRIPTION

Figure 1:
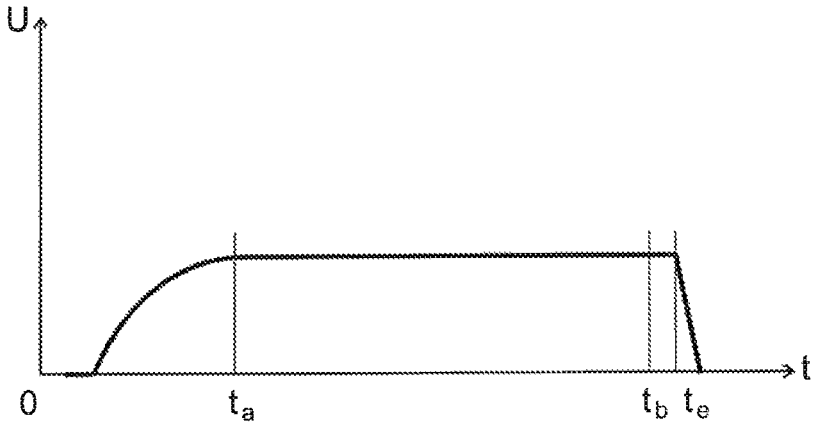
FIG. 1 shows schematically an example of the voltage curve during a corona discharge in a faultlessly functioning HF ignition system.

FIG. 1 illustrates schematically the typical curve of the voltage on the high voltage side of an HF ignition system during a corona discharge. In FIG. 1 as well as in the following figure, the voltage is plotted in each case as the root mean square voltage of the alternating voltage applied as a secondary voltage to the ignition electrode of the HF ignition system. The alternating voltage has preferably a frequency between 30 kHz and 10 MHz, in particular of 3 to 6 MHz. A corresponding voltage curve can also be measured in an intermediate circuit.

The voltage curve illustrated in FIG. 1 is generated by feeding a voltage pulse into the on-board power side of the HF ignition system. With the beginning of the voltage pulse fed into the on-board power side at the time t=0 the voltage on the high voltage side of the HF ignition system begins to increase. After a start portion of the voltage pulse, a largely stationary corona discharge is achieved at the time $t_a$. During a subsequent middle portion of the voltage pulse, the voltage hardly changes and typically has a value between 30 kV and 500 kV. Depending on the current operating point of the engine, this voltage can also have values below 30 kV, for example only 15 kV.

During an end portion of the voltage pulse, the root mean square voltage drops from the previously reached plateau value. The start portion of the voltage pulse lasts from t=0 to $t_a$. The middle portion of the voltage pulse lasts from $t_a$ to $t_b$. In order to avoid incorrect measurements caused by the voltage drop, it can be advantageous to evaluate as a middle portion only a time interval that ends a time interval At before the time $t_b$.

Figure 2:
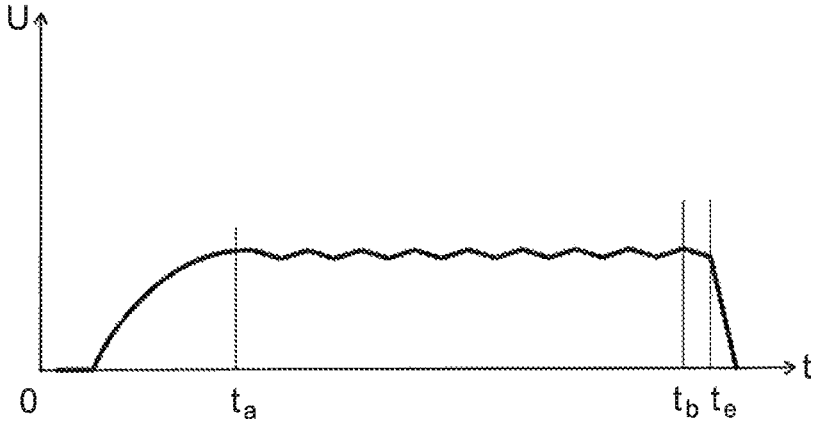
FIG. 2 shows schematically an example of the voltage curve during a pre-stage of an internal spark or sliding discharge.

FIG. 2 shows schematically an example of the voltage curve on the high voltage side of the HF ignition system as it can arise during a pre-stage of an internal spark or sliding discharge. As can be seen, the voltage curve is characterized by periodic fluctuations during the middle voltage portion. In such cases, a corona discharge useable for igniting fuel in an engine is generated; however, there is an increased risk that a pronounced, stronger spark or sliding discharge and thus a severe malfunction forms, which can result in destruction of the HF ignition system. This risk can be effectively countered in many cases by reducing the energy fed with a subsequent voltage pulse into the HF ignition system for igniting a further corona discharge.

The periodic fluctuations of the measured values illustrated in FIG. 2 result in that the series of measured values fluctuates within a significantly wider range than this is the case for the ideal curve illustrated in FIG. 1. The emerging malfunction can therefore be detected by determining a characteristic variable for the fluctuation range of the measured values and comparing said determined characteristic variable with a threshold. If the characteristic variable exceeds the threshold, an error signal is generated. The characteristic variable for the fluctuation range can be, for example, the standard deviation of the measured values. The threshold can be predetermined as an absolute value or can be calculated by multiplying a constant by a target value to which the secondary voltage is controllably set.

Fluctuations indicating a malfunction can also be detected in that a time-frequency transformation of the series of measured values, for example a wavelet transformation or a Fourier transformation, is calculated. The result of the time-frequency transformation shows the frequency spectrum of the fluctuations occurring during the middle portion of the voltage pulse between $t_a$ and $t_b$. By checking for at least one frequency range of the calculated frequency spectrum if a threshold is exceeded, it can be determined if the measured values of the series change with a frequency which is characteristic for an occurring malfunction. The monitored frequency range is preferably below the frequency of the HF ignition system's alternating voltage generated as a secondary voltage. Particularly preferred, the monitored frequency range is below half the frequency of the alternating voltage, in particular below a tenth of the frequency of the alternating voltage.

What is claimed is:

1. A method for operating an HF ignition system wherein electrical energy for generating a corona discharge is fed with a voltage pulse into the HF ignition system, and a series of measured values of an electrical variable is measured during the voltage pulse, and the measured values are evaluated in order to detect malfunctions, wherein the measured values are evaluated by determining a characteristic variable for the fluctuation range of the same and comparing said determined characteristic variable with a threshold, and an error signal is generated if the characteristic variable exceeds the threshold.

2. The method according to claim 1, wherein the characteristic variable is the standard deviation.

3. The method according to claim 1, wherein the error signal effects that the energy fed with a subsequent voltage pulse into the HF ignition for igniting a further corona discharge system is reduced.

4. The method according to claim 1, wherein the characteristic variable of the fluctuation range for the measured values measured during a middle portion of the voltage pulse is determined.

5. The method according to claim 4, wherein the middle portion begins after a transient response of a secondary voltage which is generated by feeding the voltage pulse.

6. A method for operating an HF ignition system wherein electrical energy for generating a corona discharge is fed with a voltage pulse into the HF ignition system, and a series of measured values of an electrical variable is measured during the voltage pulse, and the measured values are evaluated in order to detect malfunctions, wherein the measured values are evaluated by calculating a frequency spectrum by means of a transformation, and it is subsequently checked for at least one frequency range of the calculated frequency spectrum if a threshold is exceeded, and if this is the case, an error signal is generated.

7. The method according to claim 6, wherein the series of measured values is filtered prior to the transformation.

8. The method according to claim 6, wherein the HF ignition system has an on-board power net side and a high voltage side, wherein between the on-board power net side and the high voltage, a voltage converter is arranged which, from an on-board voltage, generates a high voltage of at least 15 kV, and wherein the electrical variable is measured on the high voltage side of the HF ignition system.

9. The method according to claim 6, wherein as an electrical variable, current and/or voltage are/is measured.

10. The method according to claim 6, wherein a lower threshold for the energy fed with a voltage pulse into the HF ignition system is predetermined, and a warning signal is generated if during a voltage pulse, the energy of which is equal to or below the lower threshold, a malfunction of the HF ignition system is detected.

* * * * *